United States Patent [19]

Luoni

[11] Patent Number: 4,599,845

[45] Date of Patent: Jul. 15, 1986

[54] AUTOMATIC DEVICE FOR THE DRAWING OF BUNDLES OF WELDED BAGS OF PLASTIC MATERIAL AND FOR THE INSERTION THEREOF INTO CONTAINER MEANS

[76] Inventor: Marco Luoni, Via Leonardo da Vinci 33, Dairago(Milan), Italy

[21] Appl. No.: 745,509

[22] Filed: Jun. 17, 1985

[30] Foreign Application Priority Data

Jun. 20, 1984 [IT] Italy ..... 22340/84[U]

[51] Int. Cl.[4] ..... B65B 35/50

[52] U.S. Cl. ..... 53/251; 53/247; 53/540

[58] Field of Search ..... 493/204; 53/251, 252, 53/531, 235, 247, 540

[56] References Cited

U.S. PATENT DOCUMENTS

| | | | |
|---|---|---|---|
| 3,977,152 | 8/1976 | Rochla et al. | 53/540 X |
| 4,333,298 | 6/1982 | Lehmacher | 53/247 X |
| 4,396,379 | 8/1983 | White et al. | 493/204 X |

*Primary Examiner*—James F. Coan

*Attorney, Agent, or Firm*—Charles E. Brown; Charles A. Brown

[57] ABSTRACT

An automatic device for the drawing of bundles of welded bags of plastic material, and the insertion of the same bundles into container means comprises essentially a first carriage, provided with means for gripping said bundles, and running in a plane parallel to the bundle feeding plane, and a second carriage, provided with means for handling said bundles and running in a lower plane parallel to the running plane of said first carriage, said carriages being both provided with driving means in said planes, said handling means being additionally suitable to run along a plane perpendicular to the said planes in order to draw said bundles in correspondence of said container means, said handling means surrounding and containing said bundles so as to keep them well assembled, said gripping means and said handling means being provided with moving means between an open position and a closed position.

7 Claims, 6 Drawing Figures

Figure 1:
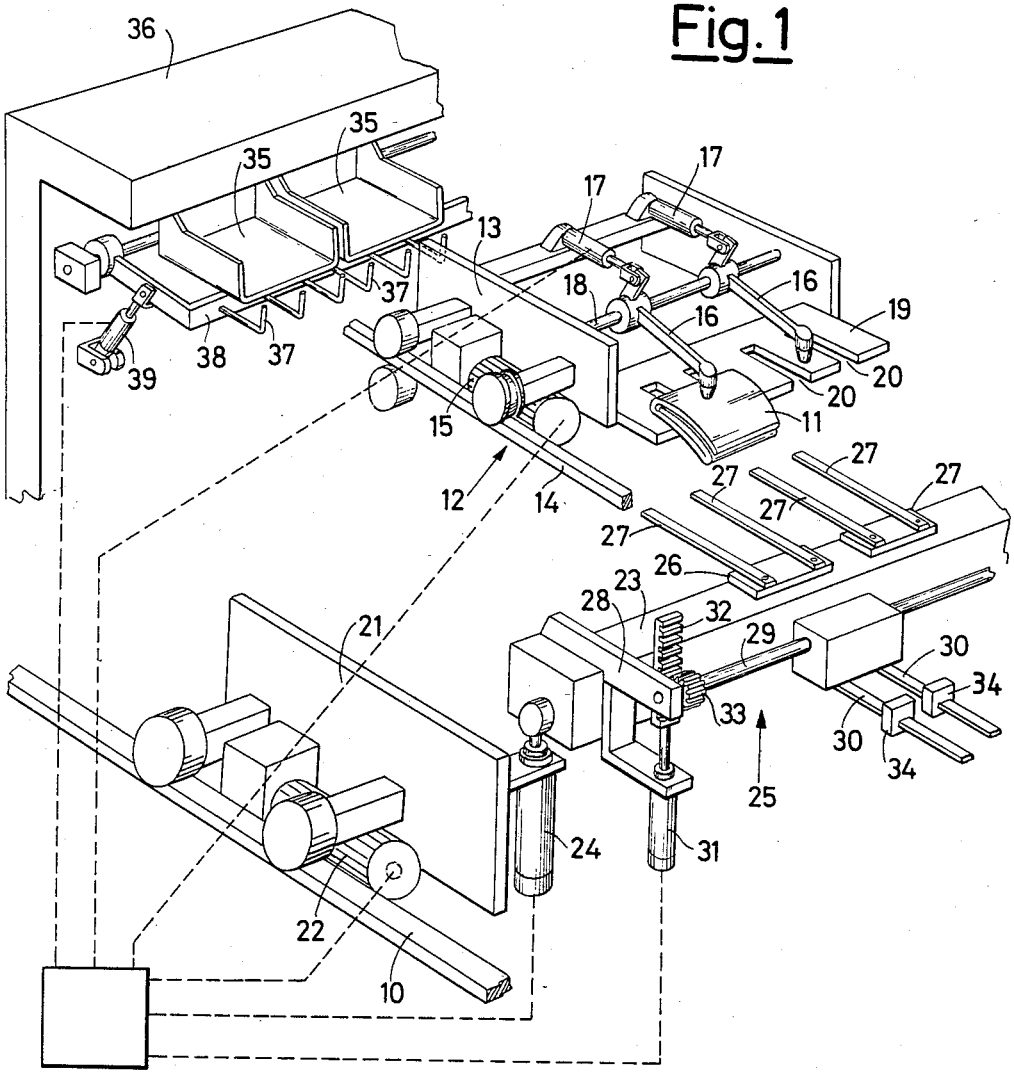

AUTOMATIC DEVICE FOR THE DRAWING OF BUNDLES OF WELDED BAGS OF PLASTIC MATERIAL AND FOR THE INSERTION THEREOF INTO CONTAINER MEANS

The present invention relates to an automatic device for the drawing of bundles of welded bags of plastic material and the insertion of the same bundles into container means.

In welding machines for plastic materials for the forming of bags, small bags and/or hand-bags of plastic material either of tubular shape or not, it is known to position the finished items on each other, as so-called "bundles" of a predetermined number of items.

Said bundles, when complete, are drawn by suitable gripper means, folded up into a number of prestated portions and laid onto withdrawal means, such as conveyor means, to be placed within collection and storage means.

The bundles laid onto said conveyor means show a tendency to disassemble during their withdrawal and can be laid within collecting means of much larger size than the single bundle.

In fact, in the bundle folded into two or four portions, the surfaces of single bags slip relatively to each other precisely due to the particular slipperiness of the plastic material from which the same bags are made.

An automatic handling and laying can thus be effected in such a way when the same bundles are to be positioned e.g. within cardboard boxes or within further container means wherein the perfect positioning or the partial disassembling of the product group does not constitute a particular problem.

If on the contrary the bundles are to be positioned within container means of slightly larger size, due to the impossibility of maintaining a perfect positioning during the automatic laying and conveyance process, a manual packing process is to be used, which causes a waste in time and personnel devoted to this single operation only.

Main purpose of the present invention is to provide a device which allows these problems to be solved and allows the drawing and the handling of the bundles in an automatic fashion and the introduction of the same into container means. This device must be moreover able to prevent the disassembling of the bundle and to allow the introduction thereof, as so well assembled, without any obstacles into any container means of any types, and also very close in size to the bundle.

These and further purposes according to the present invention are achieved by providing an automatic device for the drawing of bundles of welded bags of plastic material, and insertion of the same bundles into container means, characterized in that it essentially comprises a first carriage, provided with means for gripping said bundles, and running in a plane parallel to the bundle feeding plane, and a second carriage, provided with means for handling said bundles and running in a lower plane parallel to the running plane of the said first carriage, said carriages being both provided with driving means in said planes, said handling means being additionally suitable to run along a plane perpendicular to the said planes in order to draw said bundles from said gripping means and to bring said bundles in correspondence of said container means, said handling means surrounding and containing said bundles so as to keep them well assembled, said gripping means and said handling means being provided with moving means between an open position and a closed position.

The structural and functional characteristics and the advantages of a device according to the present invention shall be better comprised from the exemplifying and not limitative disclosure referred to the attached schematic drawings, wherein:

FIG. 1 is a schematic perspective view of a device according to the present invention as positioned at the oulet end of a welding machine, and FIGS. 2, 3, 4, 5 and 6 show details of the device of FIG. 1 in successive working positions.

Referring to the drawings e.g. in a welding machine a bundle 11 of bags of thermoplastic material, positioned on a (not shown) collecting and heaping up means, is drawn by a folding unit generally indicated by the numeral 12.

The folding unit 12 comprises a first carriage 13, controlled to slide on guides 14 by a motor means 15 installed at one side of the carriage 13.

A bell crank lever 16 controlled by a cylinder 17 to rotate around a shaft 18 acts as the gripper means for the bundles 11, by clamping them on an underlaying plate 19, in which alternating slots 20 are provided, in a comb-like arrangement (FIG. 1).

A second plate and a cylinder (not shown), suitable to vertically run and intersecting the sliding plane of the carriage 13, cooperate to effect the folding of the bundle 11.

A second carriage 21, slidable in a plane parallel to and lying under the plane of the first carriage 13 by means of its own motor means 22 along guides 10, supports a transverse beam 23, mounted to be vertically shifted by means of cylinders 24, interposed between the carriage 21 and the beam 23. A handling device, generally indicated by the numeral 25 in FIG. 1 is carried by the beam 23 and comprises a stationary portion or plate 26 from which first planar elongated elements or prongs 27 protrude, the spacing of the prongs being suitable to enter the slots 20 of the plate 19.

End cantilever supports 28 support in a rotatable way a shaft 29 bearing second planar elongated elements or prongs 30 suitable to be operatively coupled with the prongs 27 to a pincers (gripper) fashion by means of at least a cylinder 31 provided with a rack 32 which engages with a gear wheel 33 solid with the shaft 29.

The prongs 30 are provided with stop means 34 adjustable as a function of the size of the folded bundle.

Figure 4:
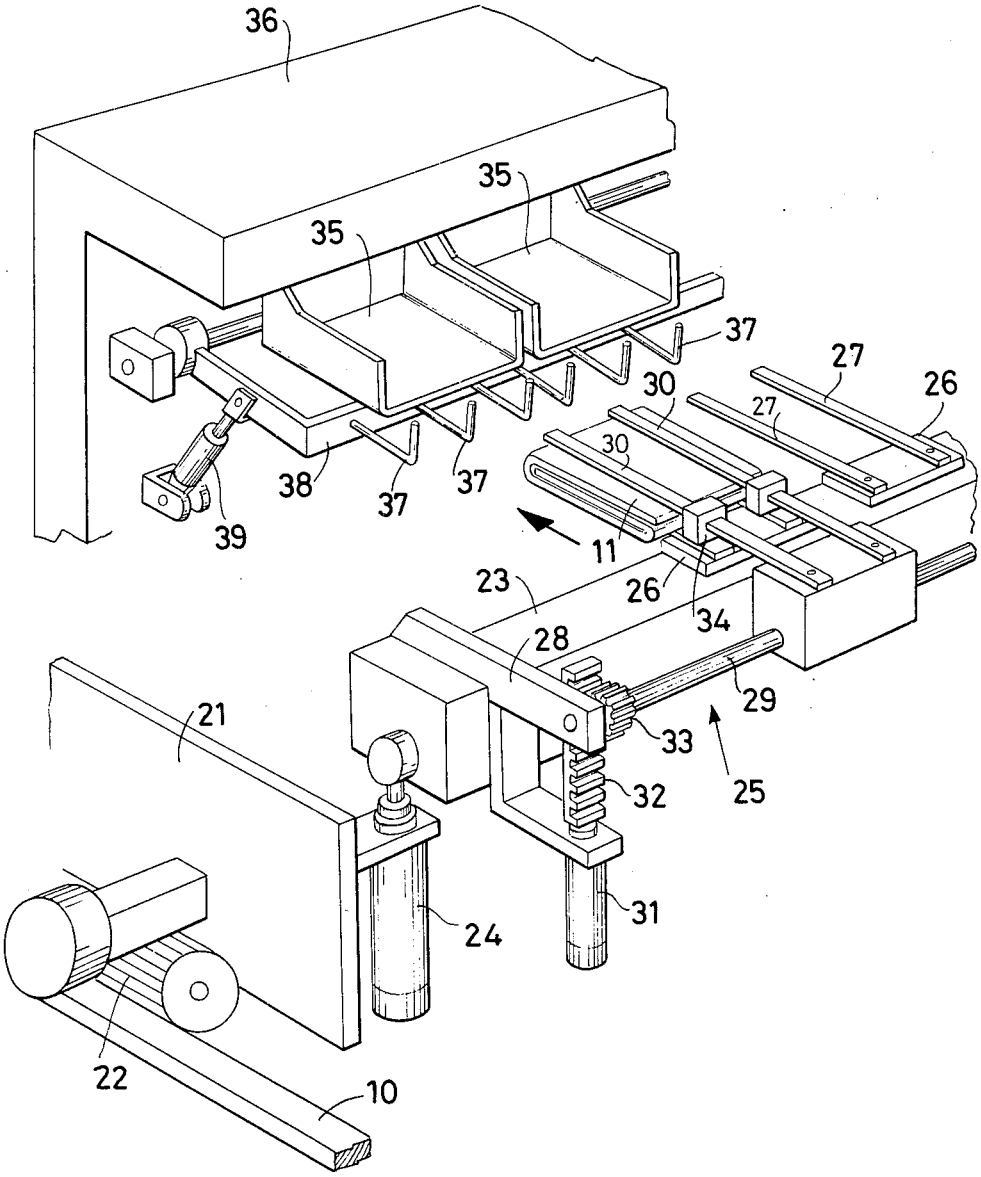
Figure 5:
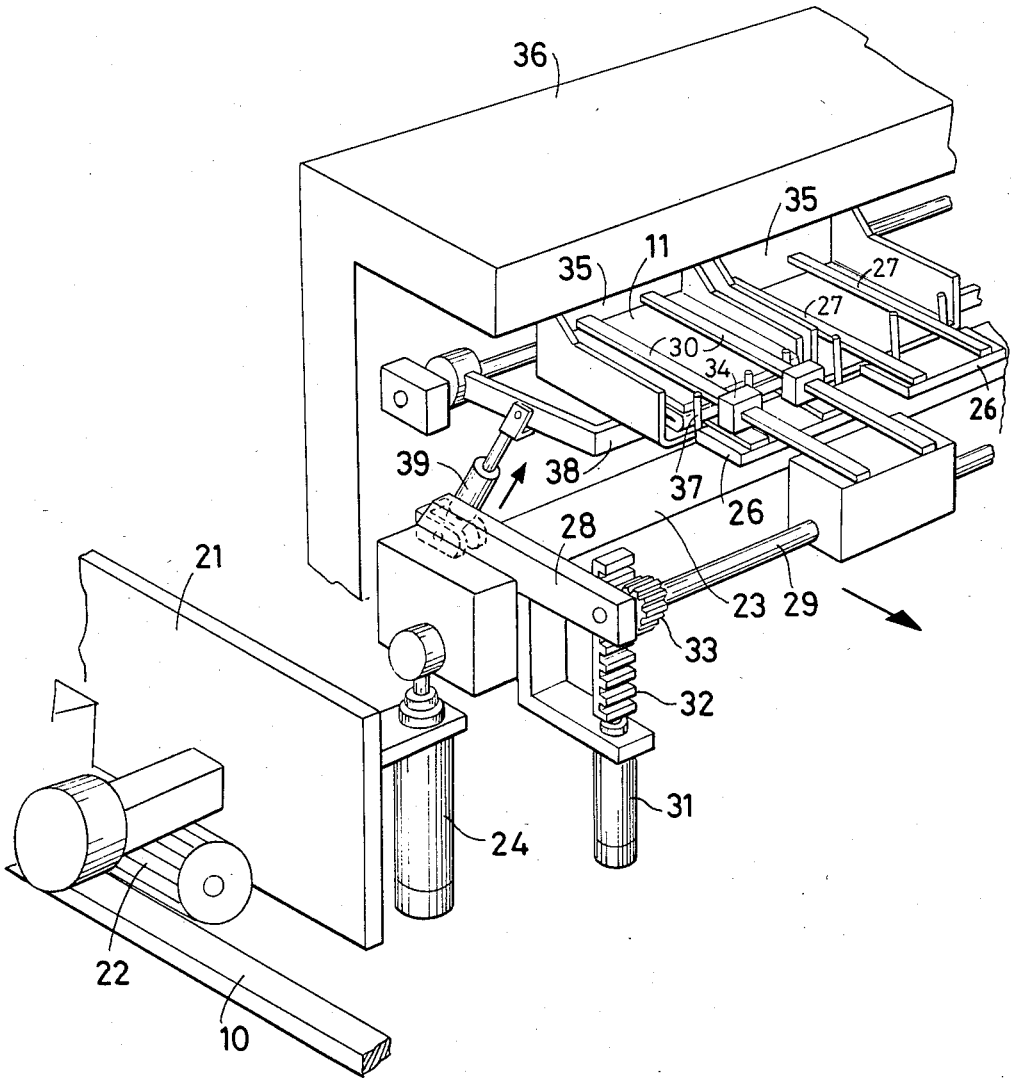

Container means 35, e.g., boxes of a continuous withdrawal device 36 for the withdrawal towards a packing machine (not shown) receive bundles 11 carried by the handling device 25 and are provided with retaining and slipping out means 37 e.g., needles bent at their free ends, constrained onto a supporting element 38 movable by means of a cylinder 39 between a lowered position under the boxes 35 and a position lifted inside the prongs 27 and 30 to keep the bundle 11 inside the box (FIGS. 4 and 5).

A device according to the present invention disclosed in the hereinabove set forth exemplifying but non limitative disclosure, operates as follows.

Bags or small e.g. coming out from the welding unit of the welding machine (not shown) are collected and heaped up on a suitable means, e.g. a crosspiece, to form one or more bundles 11 positioned parallel to each other. The bundle and/or the bundles may be in any number as well as the devices and the handling units for them may be; for simpleness' sake in the following working description, one single bundle and one single handling device shall be taken into consideration.

The bundle 11, after having been completed, is drawn by the carriage 13 by means of a lever 16 and is clamped onto the plate 19 of the same carriage. In a by-itself-known way the lever 16, together with the plate 19 and with a second (not shown) unit, composed e.g. by a second plate and by upper pressing cylinders carry out the folding of the bundle into two or four portions.

The bundle 11 of bags so folded and finally clamped by the lever 16 onto the plate 19 is shifted by the carriage 13 into correspondence with the second carriage 21 carrying the handling device 25 according to the present invention (FIG. 1). The handling device 25 has its prongs 27 and 30 opposed to each other in the open position, and its beam 23 in the lowered down position, under the carriage 13.

In an automatic way, by means of a central control and drive unit (not shown) the cylinders 24 cause the lifting of the beam 23 to bring the prongs 27 to a level to insert themselves inside the slots 20 of the plate 19.

Figure 2:
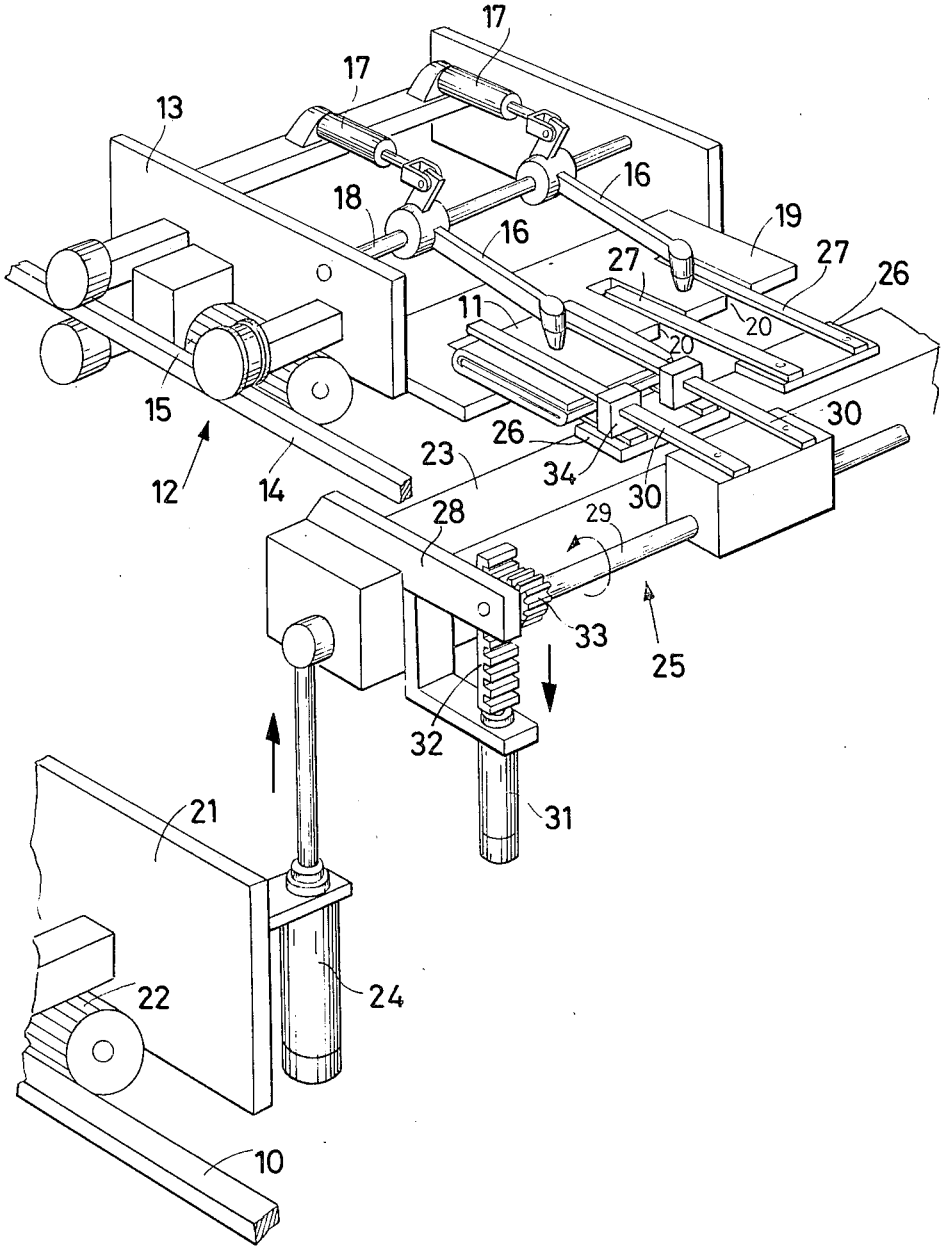

The cylinder 31 causes the movement of the rack 32 - gear wheel 33 coupling, with the consequent turning of the shaft 29 and positioning of the prongs 30 above the prongs 27, to grip each bundle 11 (FIG. 2). The cylinder 17 lifts the lever 16 thus liberating the bag bundle 11 and allowing the rearwards motion of the carriage 21 out of the support plate 19.

Figure 3:
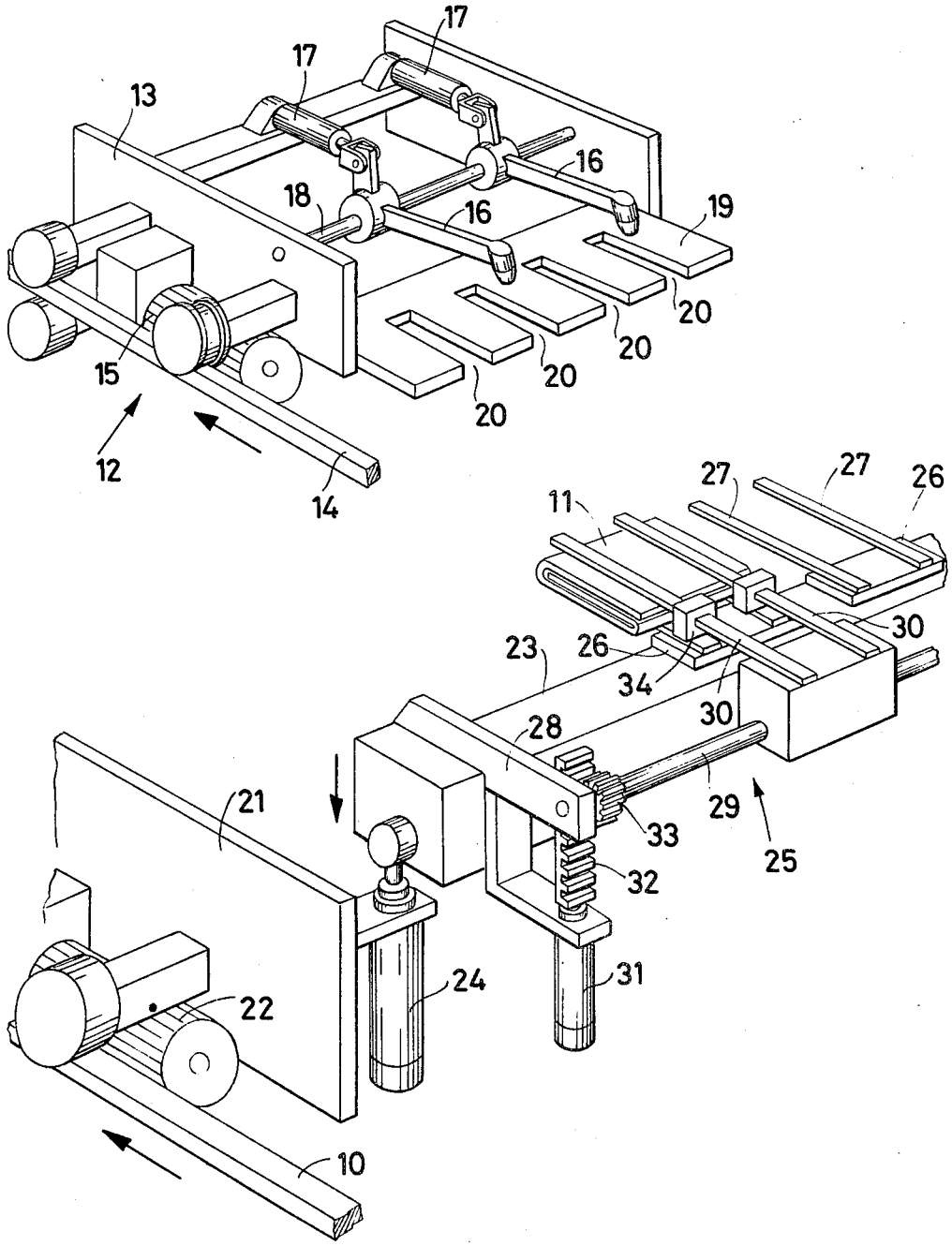

Only in this stage the cylinders 24 effect the lowering of the beam 23 with the device 25 being closed and bearing the folded bundle 11, and the subsequent run ning of the carriage 21 towards the container means 35 (FIGS. 3 and 4).

The carriage 21 slides as driven by the motor 22, along a direction parallel to that of carriage 13, on side guides 10 up to introduce the bundle 11, as clamped by the prongs 27 and 30 and flush with the stop means 34, into the box 35 (FIG. 5).

It is important to note that the box 35 may be very close in size to the bundle 11, as the insertion of the same is made easier and in secured by the perfect assembling of the same bundle and by the clamping thereof inside the handling device 25.

During this insertion operation the bent needle elements 37 are lowered down and they are lifted only when the bundle 11 is completely inserted, in order to keep it inside the box 35 (FIG. 5).

Figure 6:
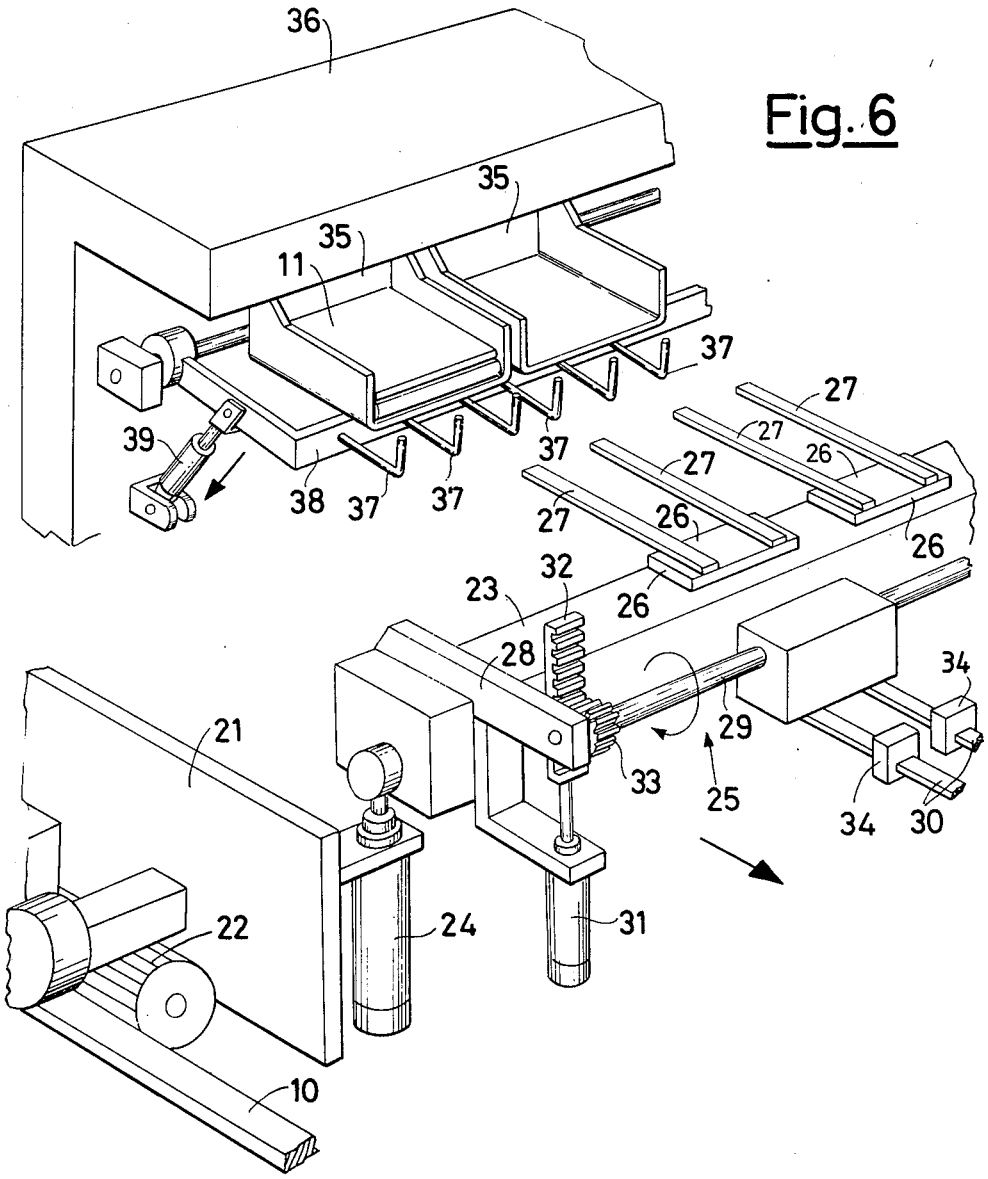

The handling device 25 is forced to come out of the box 35 by the rearward stroke of the carriage 21, leaving the bundle 11, and subsequently, during the return stroke, it opens again the prongs 27 and 30 to be ready to grip a new bundle present on the carriage 13 (FIG. 6).

The bundle or the bundles brought by the handling device 25 can be inserted inside box containers 35 forming a part of a device for the withdrawal and for the feed to a packing machine, or directly inside envelopes or containers of paper or of cardboard. The motor and/or astuator means pointed out and indicated may be of electrical, or of hydraulic, as well as of pneumatic type.

I claim:

1. Automatic device for the drawing of bundles of welded bags of plastic material, and the insertion of the same bundles into container means, said device comprising a first carriage provided with gripping means for gripping bundles and movable in a plane parallel to a bundle feeding plane, and a second carriage provided with handling means for carrying bundles and running in a plane parallel to but lower than the running plane of the said first carriage, said carriages both being provided with driving means for movement in said planes, said handling means being mounted to run in a plane perpendicular to said planes in order to draw bundles from said gripping means and to move such bundles into said container means, said handling means having means for surrounding and containing bundles so as to keep bundles well assembled, said gripping means and said handling means each being provided with moving means for movement between an open position and a closed position.

2. Device according to claim 1, characterized in that said second carriage is provided with a transverse beam translatable in said perpendicular plane and carrying said handling means, and actuator means between said carriage and said beam for effecting said perpendicular translation.

3. Device according to claim 2, characterized in that said handling means are at least a first pair of prongs constrained to said beam and at least a second pair of prongs solid with a rotatable shaft positioned in a parallel arrangement relative to said beam, said shaft being rotatable to superimpose said second pair of prongs over said first pair of prongs, and means for the control of said rotation of said second set of prongs between said superimposed position and an open position.

4. Device according to claim 3, characterized in that said gripping means comprise a bell crank lever and an underlying plate solid with said first carriage, said bell crank being controlled by a cylinder for movement from a lifted position to a position in contact with said underlying plate, and said underlying plate being moreover with a series of slots suitable to receive said prongs fixed on said beam.

5. Device according to claim 3 characterized in that at least one prong of each pair of said prongs is provided with stop means for stopping a bundle, the position of each stop means being adjustable relative to a respective one of said prongs.

6. Device according to claim 1 characterized in that said container means is a box whose size is slightly greater than that of a bundle said box is intended to receive, said box being provided with movable means for the retaining of a bundle in said box.

7. Device according to claim 1, characterized in that said motors of said carriages, of said gripping means and of said handling means are operatively linked to each other by a central control and drive unit.

* * * * *